US005874017A

United States Patent [19]

Palmer et al.

[11] Patent Number: 5,874,017

[45] Date of Patent: Feb. 23, 1999

[54] USE OF MICROCRYSTALLINE WAX AND LOW FOAMING EMULSIFIERS AS DEFOAMERS

[75] Inventors: John J. Palmer, Stanfield; Mary L. Lightsey, Charlotte; Lynn A. Lavender, Charlotte; Zhentaro He, Charlotte, all of N.C.

[73] Assignee: Geo Specialty Chemicals, Inc., Cleveland, Ohio

[21] Appl. No.: 695,483

[22] Filed: Aug. 12, 1996

[51] Int. Cl.[6] ..... D21H 21/12

[52] U.S. Cl. ..... 252/351; 252/351; 252/358; 252/321

[58] Field of Search ..... 252/351, 358, 252/321

[56] References Cited

U.S. PATENT DOCUMENTS

| | | | |
|---|---|---|---|
| 2,563,857 | 8/1951 | McGinn | 252/358 |
| 4,021,365 | 5/1977 | Sirka et al. | 252/321 |
| 4,599,189 | 7/1986 | Wuhrmann et al. | 252/174.15 |
| 4,655,960 | 4/1987 | Wuhrmann | 252/321 |
| 4,880,564 | 11/1989 | Abel et al. | 252/321 |
| 5,393,791 | 2/1995 | Roberts | 514/762 |
| 5,431,853 | 7/1995 | Tsuda et al. | 252/321 |
| 5,599,481 | 2/1997 | Waiger | 252/358 |

FOREIGN PATENT DOCUMENTS

93/00144 1/1993 WIPO .

*Primary Examiner*—Nancy Degen
*Assistant Examiner*—Deanna Baxam
*Attorney, Agent, or Firm*—Thompson Hine & Flory LLP

[57] ABSTRACT

A defoaming agent composition containing: (a) from about 10 to about 25% by weight of a microcrystalline wax having a melting point of from about 75 to about 95° C.; and (b) from about 1 to about 5% by weight of an emulsifier selected from the group consisting of alkoxylated sorbitan mono/di/trioleate, alkoxylated sorbitol hexaoleate, sorbitan mono/di/trioleate, polyethylene glycol dioleate, polyethylene glycol distearate, block copolymers of ethylene oxide and propylene oxide, and mixtures thereof; and (c) remainder, water, all weights being based on the weight of the composition.

18 Claims, 7 Drawing Sheets

| TIME (SECONDS) | 0 | | | | | | | | | | |
|---|---|---|---|---|---|---|---|---|---|---|---|
| □ 2377-3-175A | 22 | 14 | 9.5 | 9 | 7.5 | 7 | 6.5 | 5.7 | 6.8 | 10.5 |
| ◇ 2377-3-175B | 22 | 21.2 | 21.5 | 21.5 | 21.7 | 21.7 | 21.9 | 21.9 | 21.8 | 21.5 |
| △ 2377-3-175C | 22 | 21 | 21.3 | 21.5 | 21.7 | 21.5 | 21.5 | 21.5 | 21.8 | 21.8 |
| ⊡ 2377-3-175D | 22 | 21 | 21 | 21.3 | 21.5 | 21.3 | 21.7 | 21.9 | 21.9 | 21.9 |
| ◈ 2377-3-175E | 22 | 21.3 | 21.5 | 21.5 | 21.3 | 21.5 | 21.5 | 21.3 | 21.5 | 21.8 |
| ◬ COMPETITOR C | 22 | 13 | 8.5 | 7.7 | 7.2 | 7.5 | 7.3 | 9.5 | 10.5 | 13.5 |
| ○ 2377-3-162C | 22 | 5.9 | 5.5 | 6 | 8.5 | 16 | 20.3 | 21 | 21.3 | 21.5 |

USE OF MICROCRYSTALLINE WAX AND LOW FOAMING EMULSIFIERS AS DEFOAMERS

FIELD OF THE INVENTION

The present invention is generally directed to a defoaming composition capable of preventing and eliminating the formation of foam in aqueous systems. More particularly, by combining microcrystalline wax and a low foaming emulsifier a defoamer composition is formulated capable of effectively preventing the formation of foam in highly alkaline aqueous systems such as those in pulping and papermaking processes.

BACKGROUND OF THE INVENTION

Foaming in aqueous systems causes various kinds of problems in production processes in various industries, such as a decrease in productivity, an increase of defective products, a decrease in the packing ratio of products, and the like. In the pulp production industry, large amounts of foam producing substances are contained in the process water which result in the formation of problem-causing foam.

In the Kraft pulping process, pulp (wood chips) is cooked under pressure in a mixed solution of sodium hydroxide and sodium sulfide and everything other than the fiber in the wood is removed and dissolved in the solution to obtain the pulp product. The process water from the digestion process, typically referred to as black liquor, contains large amounts of sodium salts of the lignin and other components including resin.

These components possess foam forming properties during the separation process from the pulp and therefore cause problems during the pulp production process. This problem is also realized when the above-described black liquor, which remains in the separated pulp, is washed from the pulp.

Thus, as described above, the foaming caused during the pulp washing and screening processes after the digestion of the pulp feedstock results in a decrease in the efficiency of the pulp forming process. Similarly, the foaming which occurs in the papermaking process also causes various problems, such as a decrease in the strength of the paper produced, the quality of the paper made due to the presence of spots thereon, and breaks in the paper while travelling through the paper machine.

Various types of defoaming agents are presently being used in the pulp and paper manufacturing industries. However, high temperature defoaming agents are primarily oil based, either silicone and/or mineral, and are thus not environmentally friendly. Also, since they are oil based they are not readily water dispersable, resulting in their coagulation during the pulping and/or papermaking processes.

It is thus an object of the present invention to provide a defoaming composition and process which, while effective, is environmentally friendly, especially with regard to process waters with elevated temperatures.

SUMMARY OF THE INVENTION

The present invention is directed to a defoaming agent composition containing:

(a) a microcrystalline wax having a melting point of from about 60° to about 100° C.;

(b) an emulsifier selected from the group consisting of alkoxylated sorbitan mono/di/trioleate, alkoxylated sorbitol hexaoleate, sorbitan mono/di/trioleate, polyethylene glycol dioleate, polyethylene glycol distearate, block copolymers of ethylene oxide and propylene oxide, and mixtures thereof; and (c) remainder, water.

The present invention is also directed to a process for defoaming an aqueous pulp or papermaking solution involving contacting the solution with the above-disclosed defoaming agent composition.

DESCRIPTION OF THE INVENTION

Figure 1:
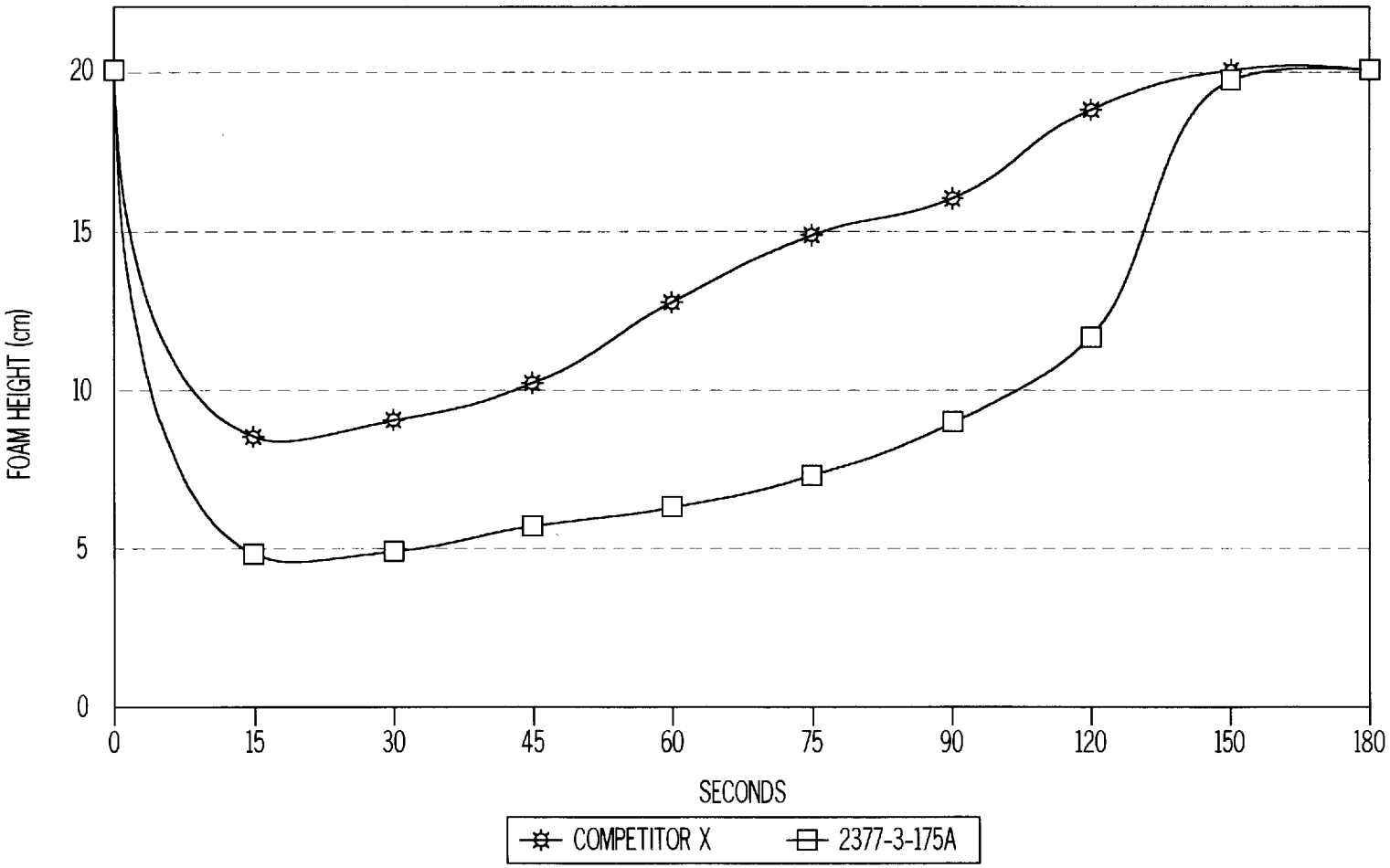
FIG. 1 is a graph comparing the defoaming capabilities of a defoaming agent composition in accordance with the present invention versus a known defoamer by measuring the decrease in amount of foam produced versus time when 25 μl of each was added to a sulfite pulping liquor, at 90° C.
Figure 2:
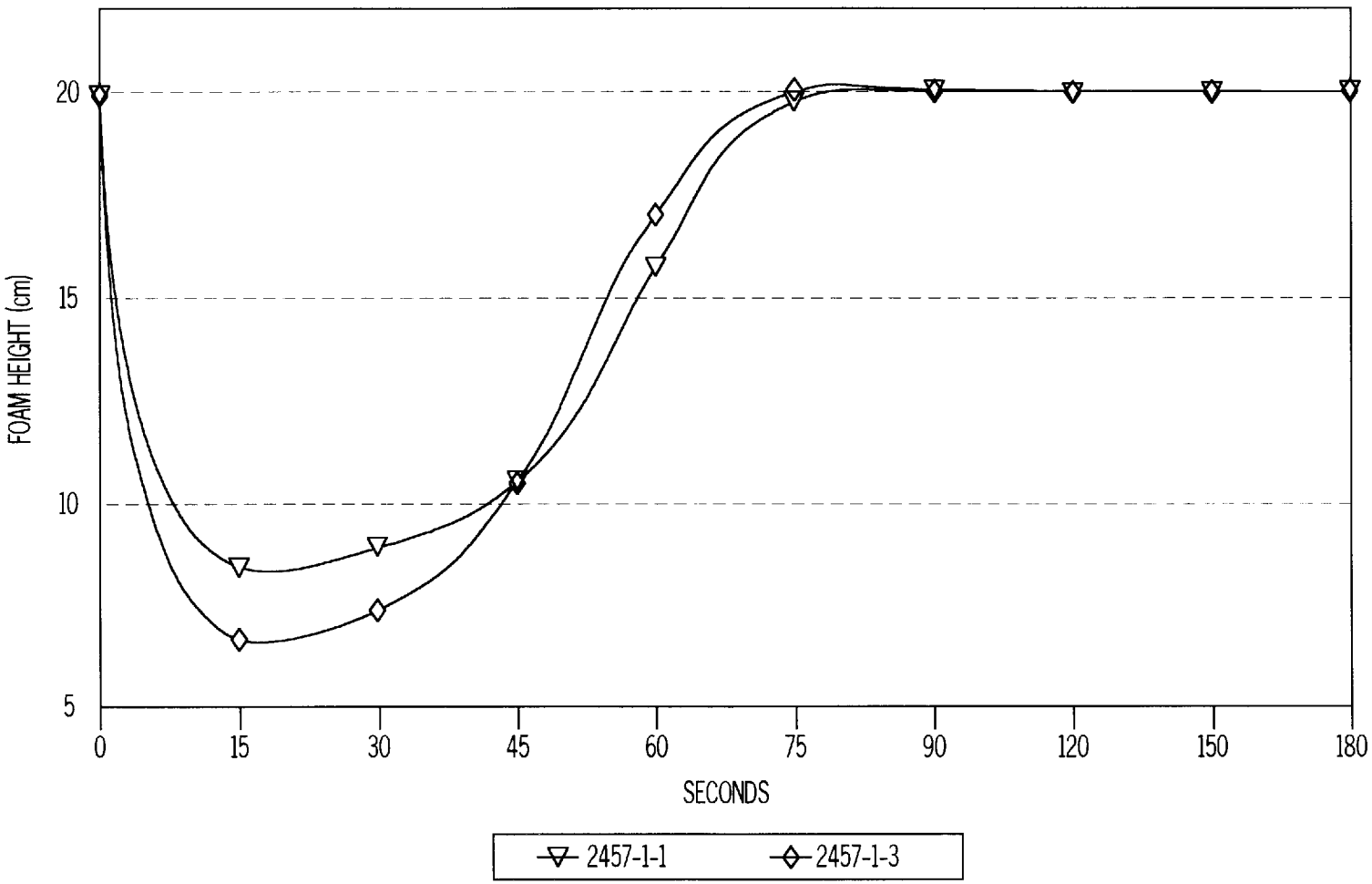
FIG. 2 is a graph illustrating the defoaming capabilities of two defoaming agent compositions in accordance with the present invention by measuring the decrease in amount of foam produced versus time when 25 μl of each was added to a sulfite pulping liquor, at 90° C.
Figure 3:
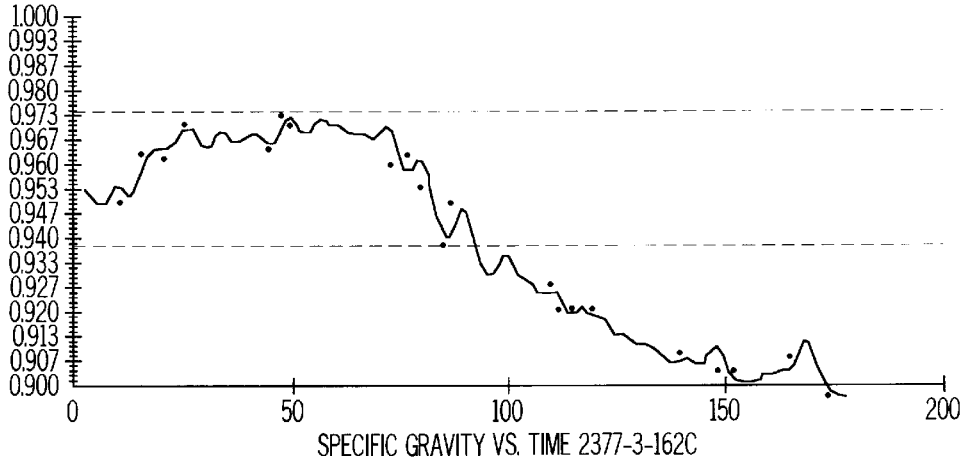
FIG. 3 is a graph illustrating the defoaming capabilities of a defoaming agent composition in accordance with the present invention by measuring the decrease in amount of foam produced versus time when 50 μl of each was added to a kraft pulping liquor, at 70° C.
Figure 4:
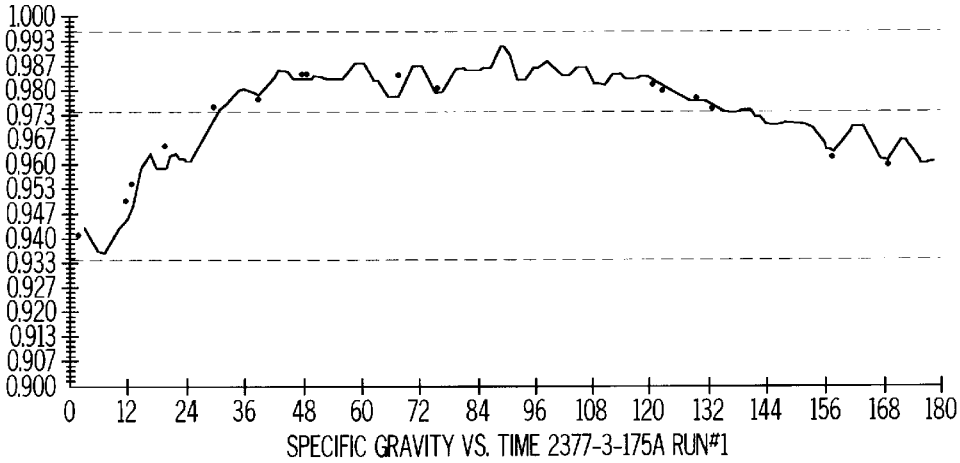
FIG. 4 is a graph illustrating the defoaming capabilities of a defoaming agent composition in accordance with the present invention by measuring the decrease in amount of foam produced versus time when 50 μl of each was added to a kraft pulping liquor, at 90° C.
Figure 5:
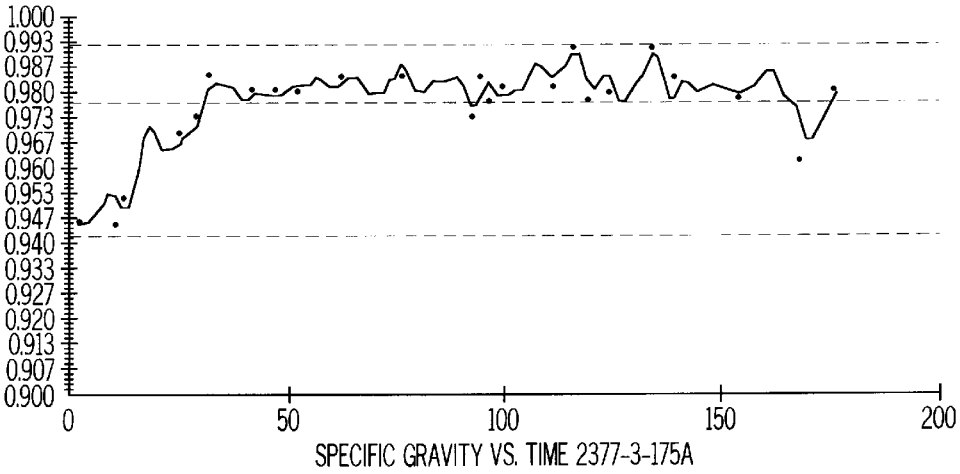
FIGS. 5–9 are graphs illustrating the defoaming capabilities of various defoaming agent compositions in accordance with the present invention by measuring the decrease in amount of foam produced versus time when 50 μl of each was added to a kraft pulping liquor, at 70° C.
Figure 6:
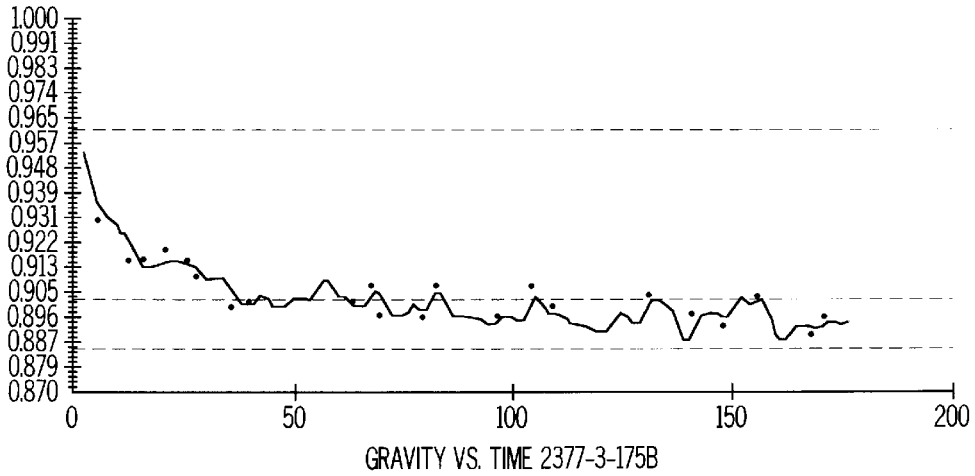
Figure 7:
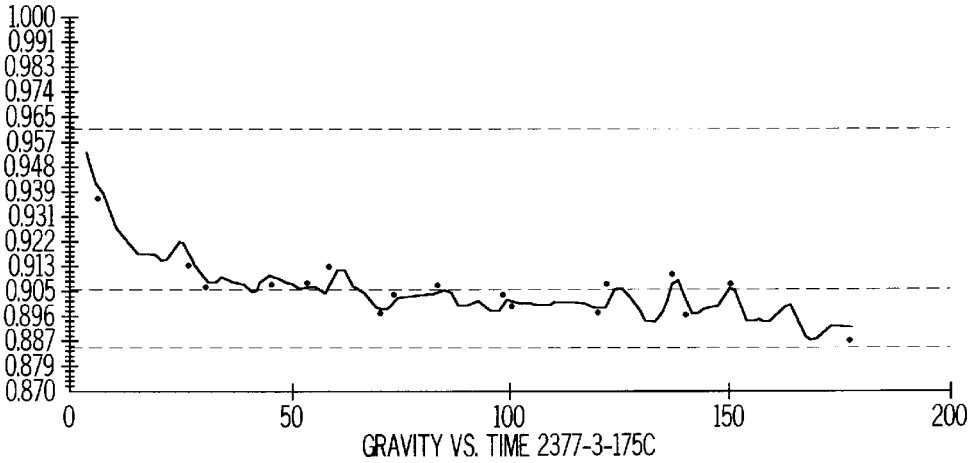
Figure 8:
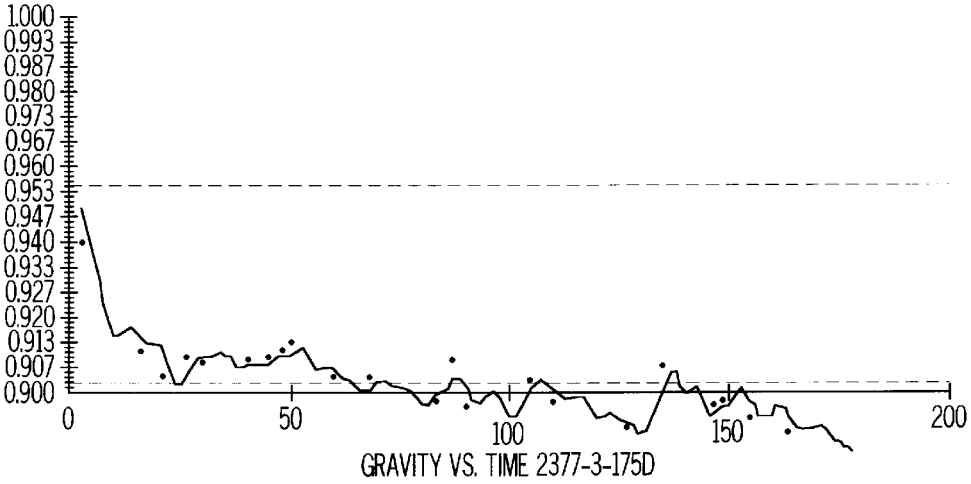
Figure 9:
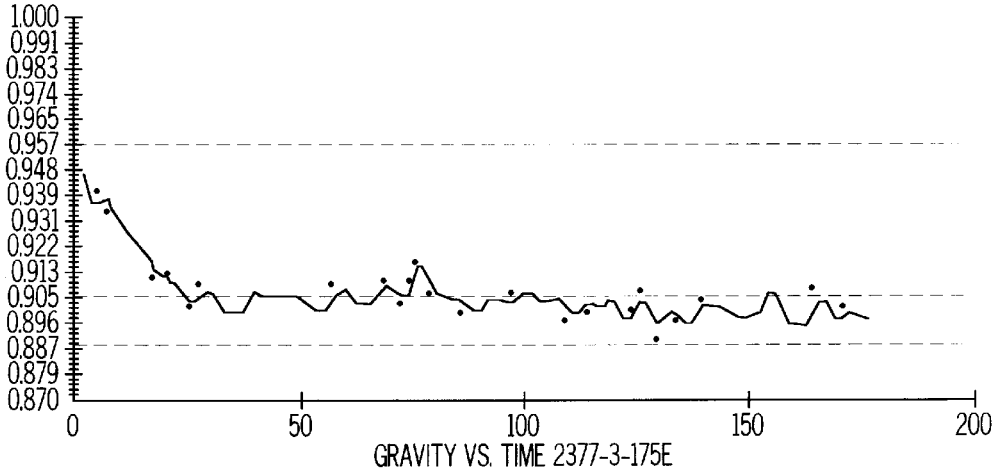
Figure 10:
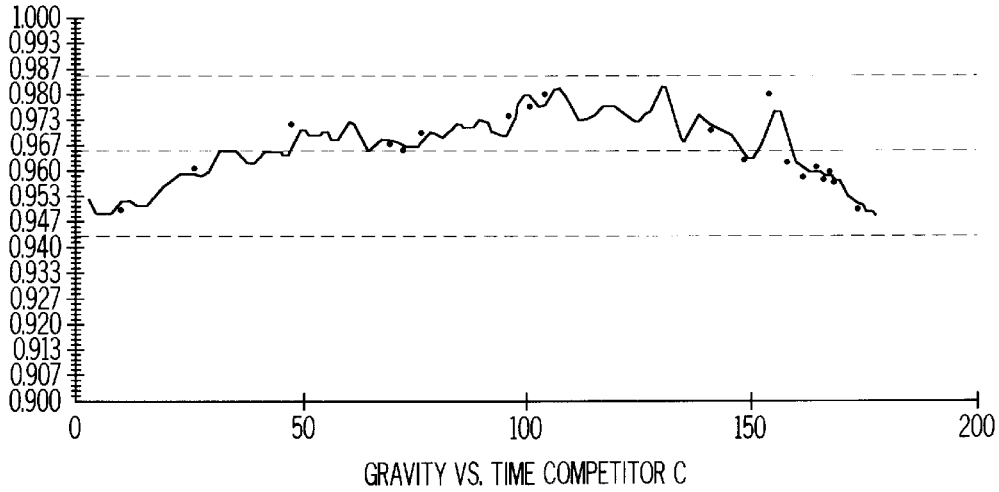
FIG. 10 is a graph illustrating the defoaming capabilities of a known defoaming agent composition in accordance with the present invention by measuring the decrease in amount of foam produced versus time when 50 μl of the known defoamer was added to a kraft pulping liquor, at 70° C.
Figure 11:
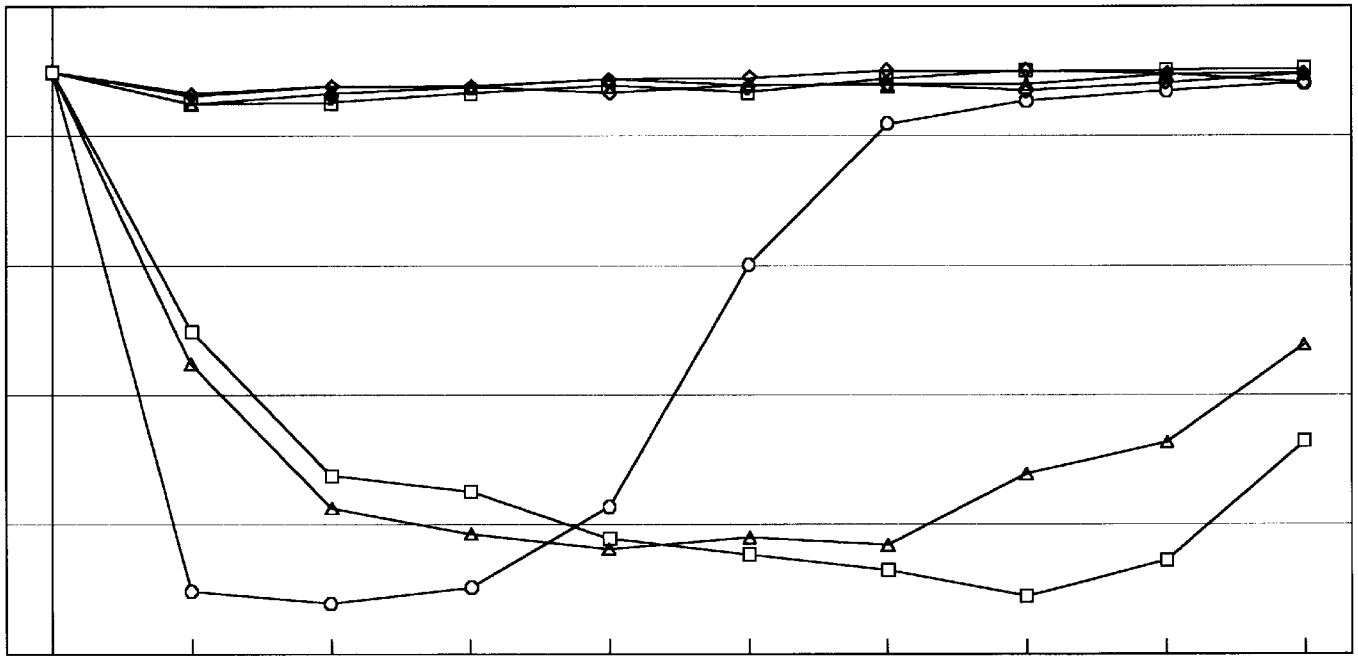
FIG. 11 is a graph comparing the defoaming capabilities of various defoaming agent compositions in accordance with the present invention, including a known defoaming composition, by measuring the decrease in amount of foam produced versus time when equal amounts of each was added to a kraft pulping liquor, at 82° C.
Figure 12:
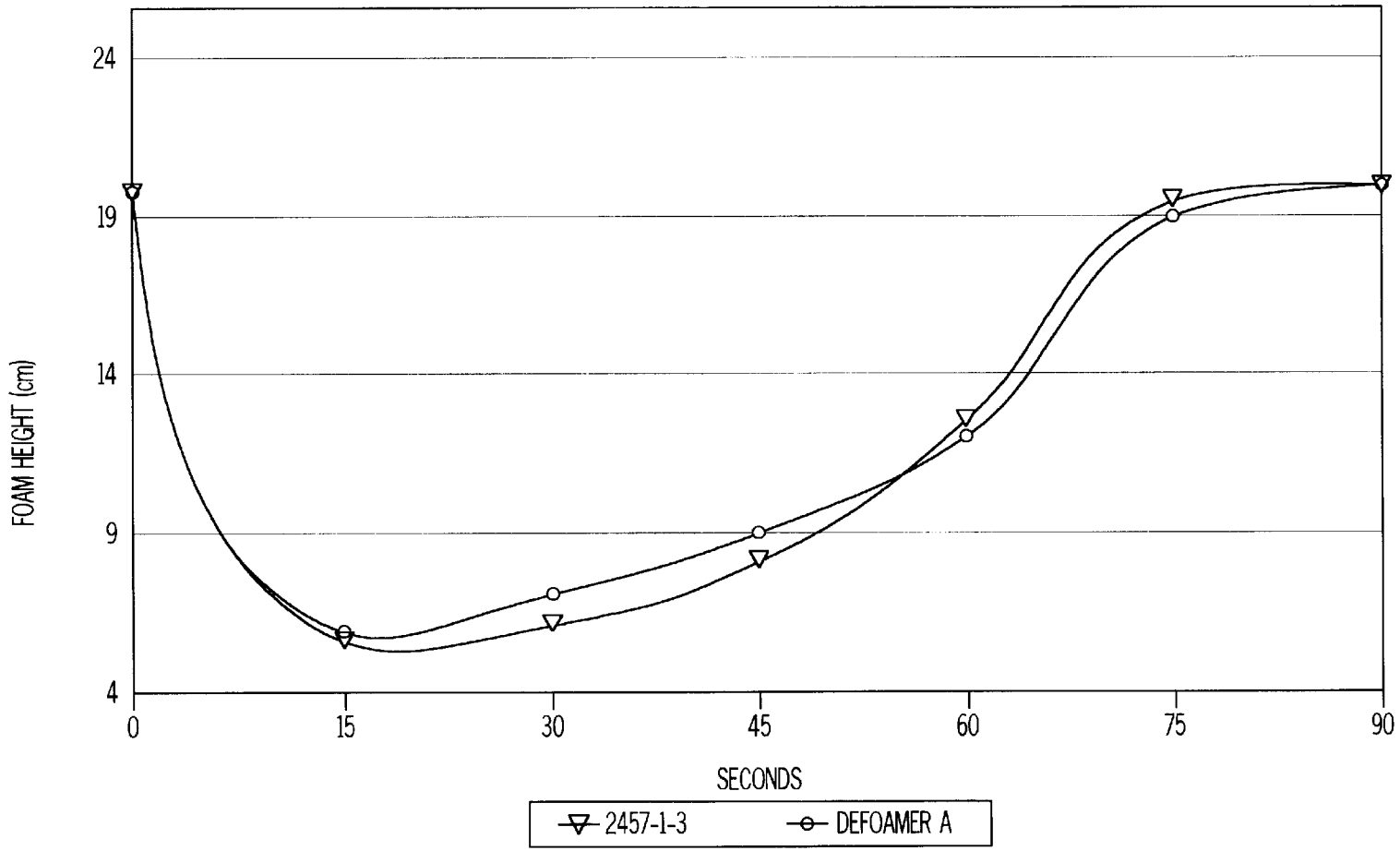
FIG. 12 is a graph comparing the defoaming capabilities of a defoaming agent composition in accordance with the present invention versus a known defoamer by measuring the decrease in amount of foam produced versus time when equal amounts of each are added to a sulfite pulping liquor, at 90° C.

Other than in the operating examples, or where otherwise indicated, all numbers expressing quantities of ingredients or reaction conditions are understood as being modified in all instances by the term "about".

The defoaming agent composition of the present invention is intended for use in high temperature applications such as those associated with the manufacture of pulp and paper. The compositions is based on at least two components, namely, a microcrystalline wax and a low foaming emulsifier.

The microcrystalline wax is characterized by its having a melting point ranging from about 60° to about 100° C., and preferably from about 75° to about 95° C. and most preferably from about 88° to about 93° C. Examples of microcrystalline and/or clay-treated microcrystalline waxes suitable for use in the present invention include, but are not limited to, BESQUARE® 195 WAX, BESQUARE® 175 WAX, STARWAX® 100 WAX, VICTORY® WAX, ULTRAFLEX® WAX, BARECO® C-1035 WAX, MELLON® WHITE WAX, and BARECO® C-700 WAX, all of which are available from Bareco, Inc.

The proportion of microcrystalline wax contained in the defoaming agent composition is generally from about 5 to about 40%, and preferably from about 10 to about 25% by weight, based on the weight of the composition.

The emulsifier component of the present invention is primarily used to emulsify the above-described microcrystalline wax component. In choosing the type of emulsifier to be used, it is preferred that it be of the low foaming variety so as not to unnecessarily cause the formation of additional unwanted foam. The emulsifier component is thus preferably selected from the group consisting of alkoxylated sorbitan mono/di/trioleate, alkoxylated sorbitol hexaoleate, sorbitan mono/di/trioleate, polyethylene glycol (PEG) 200–800 dioleate, polyethylene glycol 200–800 mono- and/or distearate, block copolymers of ethylene oxide and propylene oxide, and mixtures thereof. In a particularly preferred embodiment of the present invention, the emulsifier used is a 50/50 mixture of polyethylene glycol 400 distearate and polyethylene glycol 600 monostearate. The proportion of emulsifier contained in the defoaming agent composition is generally from about 0.1 to about 10% by weight, and preferably from about 1 to about 5% by weight, based on the weight of the composition.

While a combination of the above-disclosed microcrystalline wax and emulsifier results in the formulation of a defoaming agent composition which satisfactorily defoams aqueous pulp and papermaking solutions, additional components may also be included in order to further enhance the both the quantitative and qualitative properties of the defoaming agent composition.

Thus, in another embodiment of the present invention, there is provided a defoaming agent composition which, other than the above-disclosed microcrystalline wax and emulsifier components, further contains a hydrophobic carrier, a preservative and a stabilizing agent.

Examples of suitable hydrophobic carriers include, for example, a Guerbet alcohol having the general formula:

$$R-CH_2-CH_2-\underset{\underset{R'}{|}}{CH}-CH_2-OH$$

wherein R and R' may be the same or different and represent alkyl radicals containing from 4 to 16 carbon atoms. Guerbet alcohols are single-branch, isoalcohols obtained by the Guerbet reaction from fatty alcohols. Guerbet alcohols containing a total of 18 to 30 carbon atoms are particularly preferred for the defoaming agent composition of the present invention.

Another example of a suitable hydrophobic carrier is hydrophobic silica. The hydrophobic silica which may be employed in the present invention is a microfine silica produced by precipitation from silicate solutions, and particularly by the pyrogenic decomposition of silicon tetrachloride and which has been reacted in known manner with organochlorosilanes. The hydrophobic silica has a specific surface area between 100 and 300 $m_2/g$ and the average primary particle size is between about 3 m$\mu$ and 50 m$\mu$. It should be noted, however, that fumed silica having similar surface areas but smaller particle sizes, i.e., 12 to 16 nanometers, may also be employed without departing from the spirit of the invention.

The hydrophobic carrier will generally be used in an amount ranging from about 5 to about 25% by weight, and preferably from about 8 to about 12% by weight, based on the weight of the composition. In the event that both a Guerbet alcohol and hydrophobic silica are used as the carrier component in the defoaming agent composition, they will be combined in a ratio by weight of from about 20:1 to about 5:1, respectively.

It may be desirable to employ a stabilizing agent in the defoaming agent composition of the invention in order to provide long term stability or shelf-life to the composition by maintaining a one phase system with no settling or agglomeration. In the event that a stabilizing agent is used, examples of suitable stabilizing agents include, but are not limited to, high molecular polyacrylates, naturally derived gums, and other high molecular weight water soluble polymers. The stabilizing agent will typically be present in an amount ranging from about 0.1 to about 1.0, and preferably from about 0.3 to about 0.6% by weight, based on the weight of the composition. A particularly preferred stabilizing agent is xanthan gum.

A preservative may also be employed in the defoaming composition in order to preclude the composition from chemically breaking down during storage. Examples of preservatives which may be employed include, but are not limited to, glutaraldehyde, methyl paraben, propyl paraben, tetrahydro-35-dimethyl-2H-1,3,5-thiadiazine-2-thione, isothiazolinone, and mixtures thereof. A preservative will typically be employed in an amount ranging from about 0.01 to about 0.20% by weight, and preferably from about 0.05 to about 0.10% by weight, based on the weight of the composition.

In a particularly preferred embodiment of the present invention, there is provided a defoaming agent composition containing: (a) from about 10 to about 20% by weight of a microcrystalline wax having a melting point of from about 88° to about 93° C.; (b) from about 1 to about 5% by weight of a 50/50 mixture of polyethylene glycol 400 distearate and polyethylene glycol 600 monostearate; (c) from about 3 to about 5% by weight of a $C_{16}$ to $C_{18}$ Guerbet alcohol; and (d) from about 0.5 to about 2% by weight of hydrophobic silica, all weights being based on the weight of the composition.

The present invention also provides a process for defoaming an aqueous pulping/papermaking solution involving contacting the solution with a defoaming agent composition as disclosed above. In general, from about 0.2 to about 4 pounds, per dry ton of pulp/paper, of the defoaming agent composition is added, continuously, to the pulp/papermaking solution, the solution having a temperature ranging from about 25° to about 90° C., and a pH ranging from about 4 to about 11. While the use of common defoaming agents in association with relatively low temperature applications such as dishwashing and clothes washing are known, the very high temperatures and extreme alkaline conditions associated with pulping/papermaking applications necessitates the use of unique defoaming agents capable of functioning effectively under such harsh conditions. The present defoaming agent composition and process meet this criteria without the use of any mineral oils and/or silicone which are toxic to the environment and necessitate expensive recovery procedures.

It should also be noted that the defoaming agent compositions of the present invention qualify under FDA regulations for direct food contact applications based on the components chosen in formulating the compositions of the present invention.

The present invention will be better understood from the examples which follow, all of which are intended to be illustrative only and not meant to unduly limit the scope of the invention. Unless otherwise indicated, percentages are on a weight-by-weight basis.

EXAMPLES

Various defoaming agents were tested to determine their foam-decreasing properties. Foam testing was performed using an automatic foam cell tester. The results obtained are illustrated in FIGS. 1–12. The formulation of the individual examples tested is found in Table 1 below.

TABLE 1

| FIGURE | EXAMPLE | ACTIVE INGREDIENT(S) |
|---|---|---|
| FIG. 1 | COMP. X | PARAFFIN WAX (WATER BASED) |
| FIG. 1 | 2377-175A | MICROCRYSTALLINE WAX (WATER BASED) |
| FIG. 2 | 2457-1-1 | MICROCRYSTALLINE WAX (WATER BASED) |
| FIG. 2 | 2457-1-3 | MICRO. WAX + GUERBET ALCOHOL + SILICA (WATER BASED) |
| FIG. 3 | 2377-3-162C | MICRO. WAX + GUERBET ALCOHOL + SILICA (WATER BASED) |
| FIG. 4 | 2377-3-175A | MICROCRYSTALLINE WAX (WATER BASED) |
| FIG. 5 | 2377-3-175A | MICROCRYSTALLINE WAX (WATER BASED) |
| FIG. 6 | 2377-3-175B | PARAFFIN WAX + FATTY ALCOHOL (WATER BASED) |
| FIG. 7 | 2377-3-175C | PARAFFIN WAX + FATTY ALCOHOL (WATER BASED) |
| FIG. 8 | 2377-3-175D | PARAFFIN WAX + FATTY ALCOHOL (WATER BASED) |
| FIG. 9 | 2377-3-175E | PARAFFIN WAX + FATTY ALCOHOL (WATER BASED) |
| FIG. 10 | COMP. C | PARAFFIN WAX (WATER BASED) |
| FIG. 11 | 2377-3-175A | MICROCRYSTALLINE WAX (WATER BASED) |
| FIG. 11 | 2377-3-175B | PARAFFIN WAX + FATTY ALCOHOL (WATER BASED) |
| FIG. 11 | 2377-3-175C | PARAFFIN WAX + FATTY ALCOHOL (WATER BASED) |
| FIG. 11 | 2377-3-175D | PARAFFIN WAX + FATTY ALCOHOL (WATER BASED) |
| FIG. 11 | 2377-3-175E | PARAFFIN WAX + FATTY ALCOHOL (WATER BASED) |
| FIG. 11 | COMP. C | PARAFFIN WAX (WATER BASED) |
| FIG. 11 | 2377-3-162C | GUERBET ALCOHOL + SILICA (WATER BASED) |
| FIG. 12 | 2457-1-3 | MICRO. WAX + GUERBET ALCOHOL + SILICA (WATER BASED) |
| FIG. 12 | DEFOAMER A | ETHYLENE BIS-STEARAMIDE + SILICA/SILICONE OIL (WATER-IN-OIL EMULSION BASED) |

What is claimed is:

1. A defoaming agent composition consisting essentially of (a) from about 5 to about 40% by weight of a microcrystalline wax having a melting point of from about 60° to about 100° C.; and (b) from about 0.1 to about 10% by weight of an emulsifier selected from the group consisting of alkoxylated sorbitan mono/di/trioleate, alkoxylated sorbitol hexaoleate, sorbitan mono/di/trioleate, polyethylene glycol dioleate, polyethylene glycol distearate, block copolymers of ethylene oxide and propylene oxide, and mixtures thereof; and (c) remainder, water, all weights being based on the weight of the composition.

2. The composition of claim 1 wherein the microcrystalline wax has a melting point ranging from about 75° to about 95° C.

3. The composition of claim 1 wherein the emulsifier is a 50/50 mixture of polyethylene glycol 400 distearate and polyethylene glycol 600 monostearate.

4. The composition of claim 1 further including a hydrophobic carrier selected from the group consisting of a Guerbet alcohol, a hydrophobic silica, and mixtures thereof.

5. The composition of claim 4 wherein the hydrophobic carrier is present in the composition in an amount ranging from about 5 to about 25% by weight, based on the weight of the composition.

6. The composition of claim 5 wherein the hydrophobic carrier consists of a mixture of from about 8 to about 12% by weight of a $C_{16}$ to $C_{18}$ Guerbet alcohol, and from about 0.4 to about 2.4% by weight of a hydrophobic silica, all weights being based on the weight of the composition.

7. The composition of claim 1 further including a stabilizing agent selected from the group consisting of high molecular weight polyacrylates, naturally derived gums, high molecular weight water soluble polymers other than acrylates, and mixtures thereof.

8. The composition of claim 7 wherein the stabilizing agent is present in the composition in an amount ranging from about 0.1 to about 1.0% by weight, based on the weight of the composition.

9. The composition of claim 8 wherein the stabilizing agent is xanthan gum.

10. The composition of claim 1 further including from about 0.01 to about 0.20% by weight of a preservative selected from the group consisting of glutaraldehyde, methyl paraben, propyl paraben, tetrahydro-35-dimethyl-2H-1,3,5-thiadiazine-2-thione, isothiazolinone, and mixtures thereof.

11. The composition of claim 10 wherein the preservative is present in the composition in an amount ranging from about 0.05 to about 0.10% by weight, based on the weight of the composition.

12. The composition of claim 11 wherein the preservative is glutaraldehyde.

13. The composition of claim 1 wherein the microcrystalline wax is present in an amount of from about 10 to about 25% by weight, based on the weight of the composition.

14. The composition of claim 1 wherein the emulsifier is present in an amount ranging from about 1 to about 5% by weight, based on the weight of the composition.

15. The composition of claim 2 wherein the microcrystalline wax has a melting point of from about 88to about 93° C.

16. A defoaming agent composition for use in pulp/papermaking applications consisting essentially of (a) from about 10 to about 25% by weight of a microcrystalline wax having a melting point ranging from about 88° to about 93° C.;

(b) from about 1 to about 5% by weight of an emulsifier selected from the group consisting of alkoxylated sorbitan mono/di/trioleate, alkoxylated sorbitol hexaoleate, sorbitan mono/di/trioleate, polyethylene glycol dioleate, polyethylene glycol distearate, block copolymers of ethylene oxide and propylene oxide, and mixtures thereof;

(c) from about 8 to about 12% by weight of a $C_{16}$ to $C_{18}$ Guerbet alcohol; and (d) from about 0.4 to about 2.4% by weight of a hydrophobic silica; and (e) remainder, water, all weights being based on the weight of the composition.

17. The composition of claim 16 further including from about 0.3 to about 0.6% by weight, based on the weight of the composition, of a stabilizing agent selected from the group consisting of high molecular weight polyacrylates, naturally derived gums, high molecular weight water soluble polymers other than acrylates, and mixtures thereof.

18. The composition of claim 16 further including from about 0.05 to about 0.10% by weight of a preservative selected from the group consisting of glutaraldehyde, methyl paraben, propyl paraben, tetrahydro-35-dimethyl-2H-1,3,5-thiadiazine-2-thione, isothiazolinone, and mixtures thereof.

* * * * *